US006501240B2

(12) United States Patent
Ueda et al.

(10) Patent No.: US 6,501,240 B2
(45) Date of Patent: Dec. 31, 2002

(54) LINEAR COMPRESSOR DRIVING DEVICE, MEDIUM AND INFORMATION ASSEMBLY

(75) Inventors: Mitsuo Ueda, Kadoma (JP); Kaneharu Yoshioka, Katano (JP); Hideki Nakata, Shijonawate (JP); Hiroshi Hasegawa, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 151 days.

(21) Appl. No.: 09/727,020

(22) Filed: Nov. 30, 2000

(65) Prior Publication Data

US 2001/0005320 A1 Jun. 28, 2001

(30) Foreign Application Priority Data

Nov. 30, 1999 (JP) ..... 11-339197

(51) Int. Cl.[7] ..... H02K 41/02

(52) U.S. Cl. ..... 318/135; 310/12; 318/119; 318/127; 318/811; 37/95; 37/97

(58) Field of Search ..... 318/119, 126, 318/127, 128, 135, 811, 812; 310/12, 15, 17; 363/37, 41, 97, 98, 40, 95

(56) References Cited

U.S. PATENT DOCUMENTS 4,772,828 A * 9/1988 Heymann et al. ..... 318/128
5,420,778 A * 5/1995 Yoshino ..... 363/41
5,980,211 A 11/1999 Tojo et al. ..... 417/45
6,259,615 B1 * 7/2001 Lin ..... 363/98
6,271,508 B1 * 8/2001 Thompson et al. ..... 219/663
6,437,302 B1 * 8/2002 Bowers ..... 219/661
6,437,524 B1 * 8/2002 Dimanstein ..... 318/135

FOREIGN PATENT DOCUMENTS

JP 10-26083 1/1998

* cited by examiner

*Primary Examiner*—Nestor Ramirez
*Assistant Examiner*—Judson H. Jones
(74) *Attorney, Agent, or Firm*—RatnerPrestia

(57) ABSTRACT

A linear compressor driving device for linear compressor driving a piston in a cylinder by means of a linear motor to generate a compressed gas, has an inverter for outputting an alternating current to be supplied to the linear motor; current detecting means for detecting an output current from the inverter; voltage detecting means for detecting an output voltage from the inverter; current amplitude value determining means for determining a current amplitude value of the output current; output power calculating means for calculating an output power from the inverter based on the detected output current and the detected output voltage; frequency determining means for determining a frequency of the output current such that the output power is maximum; and inverter controller for controlling the inverter based on the determined current amplitude value and the determined frequency.

18 Claims, 9 Drawing Sheets

LINEAR COMPRESSOR DRIVING DEVICE, MEDIUM AND INFORMATION ASSEMBLY

BACKGROUND OF THE INVENTION

1. Field of the Invention

The present invention relates to a driving device for linear compressor which, for example, reciprocates a piston in a cylinder by means of a linear motor to generate a compressed gas in a compression chamber formed of the cylinder and the piston.

2. Related Art of the Invention

A linear compressor for generating a compressed gas using the elasticity of a mechanical elastic member or the compressed gas has been known.

Thus, the configuration and operation of a conventional linear compressor using a spring as an elastic member will be described with reference to FIG. 7, which is a view showing the configuration of a conventional linear compressor.

A cylinder 60 supports a piston 61 in such a manner that the piston 61 can slide along an axial direction thereof. The piston 61 has magnets 62 fixed thereto. Stator coils 64 embedded in an outer yoke 63 are disposed opposite to the magnets 62.

A compression chamber 65 formed of the cylinder 60 and the piston 61 has a suction pipe 66 and an discharge pipe 67 connected thereto. The suction pipe 66 has a suction valve 68, and the discharge pipe 67 has an discharge valve 69. Additionally, the piston 61 is elastically supported by a resonance spring 70.

When power is continuously supplied via a motor driver (not shown) to a linear motor 71 comprising the outer yoke 63, the stator coils 64, and the magnets 62, the piston 61 reciprocates in its axial direction to suck and compress a refrigerant in the compression-chamber 65.

For efficient driving, the linear compressor must be driven with a resonance frequency. The resonance frequency of the linear compressor is determined by (1) the elasticity of a mechanically installed elastic member and a compressed gas if the compressor includes this elastic member or by (2) only the elasticity of the compressed gas if the compressor uses only this elasticity of the compressed gas.

In either case, however, the elasticity of the compressed gas varies significantly with variations in loads, so that the resonance frequency of the linear compressor cannot be uniquely determined. A method has thus been used which attempts to calculate the varying resonance frequency using a phenomenon where a resonant state is established when an input current and a piston speed have an equal phase (Japanese Patent Laid-Open No. 10-26083).

Then, an example of such a method will thus be explained in brief with reference to FIG. 8, which is a flow chart useful in explaining a resonance following operation of a conventional linear compressor with a position sensor.

When resonance frequency detection control is started, a sine wave current command value Iref input to the linear compressor is created from a driving frequency f in step S20. In step S21, positional information on the piston from the position sensor installed in the linear compressor is used to determine the current velocity Vnow of the piston.

In step S22, a difference in phase between the determined value Iref and the velocity Vnow is determined. If the phase of the value Iref is faster than that of the velocity Vnow, the process proceeds to step S23. If the phases are equal, the process proceeds to step S24. If the phase of the value Iref is slower, the process proceeds to step S25.

Since in step S22, the current drive frequency is lower than the resonance frequency, the drive frequency f is increased and the process then returns to step S20. Since in step S23, the current drive frequency and the resonance frequency are equal, the process returns to step S20 without changing any drive frequency f. Since in step S24, the current drive frequency is higher than the resonance frequency, the drive frequency f is reduced and the process then returns to step S20.

In this manner, the positional information on the piston obtained from the position sensor has been used to control the drive frequency so as to equal the resonance frequency.

SUMMARY OF THE INVENTION

Using this method, however, requires the displacement of the piston in the cylinder to be measured as described above, thereby requiring a displacement measuring device to be integrated into the linear compressor. Consequently, only the volume of the linear compressor not only increases by an amount corresponding to the volume of the displacement measuring device, but also the displacement measuring device itself must be enclosed in a shell of the linear compressor, and there is a problem that an operating reliability of the displacement measuring device must be ensured under hard operational conditions for temperature, pressure or the like.

In view of the above conventional problems, it is an object of the present invention to provide a linear compressor driving device that efficiently drives a linear compressor without using the displacement of a piston, medium and information assembly.

One aspect of the present invention is a linear compressor driving device for linear compressor driving a piston in a cylinder by means of a linear motor to generate a compressed gas, comprising:

an inverter for outputting an alternating current to be supplied to said linear motor;

current detecting means for detecting an output current from said inverter;

voltage detecting means for detecting an output voltage from said inverter;

current amplitude value determining means for determining a current amplitude value of said output current;

output power calculating means for calculating an output power from said inverter based on said detected output current and said detected output voltage;

frequency determining means for determining a frequency of said output current such that said output power is maximum; and inverter controller for controlling said inverter based on said determined current amplitude value and said determined frequency.

another aspect invention of the present invention is the linear compressor driving device wherein said voltage detecting means has:

DC voltage detecting means for detecting a DC voltage input to said inverter; and output voltage calculating means for calculating the output voltage from said inverter based on a control signal transmitted from said inverter controller to said inverter and on said detected DC voltage.

Still another aspect of the present invention is the linear compressor driving device, wherein said frequency determining means has two variables including a frequency control period and a frequency variation to compare said output power obtained through an operation with a frequency determined during said frequency control period before last with said output power obtained through an operation with a frequency determined during the last frequency control period, in order to determine a present frequency (1) by varying said frequency in the same direction as that during said last frequency control period, by an amount corresponding to said frequency variation if said output power has increased, and (2) by varying said frequency in a direction opposite to that during said last frequency control period, by said amount corresponding to said frequency variation if said output power has decreased.

Yet another aspect of the present invention is the linear compressor driving device, wherein said frequency determining means varies said frequency in said same direction a predetermined number of times or more, and maintains the frequency determined during said last frequency control period if said output power has varied by a predetermined amount or more.

Still yet another aspect of the present invention is the linear compressor driving device, wherein said frequency determining means changes said frequency control period based on a variation in said output power.

A further aspect of the present invention is the linear compressor driving device, wherein said frequency determining means changes said frequency variation based on a variation in said output power.

A still further aspect of the present invention is the linear compressor driving device, wherein said frequency determining means maintains said determined frequency if said determined current amplitude value has varied.

A yet further aspect of the present invention is the linear compressor driving device, wherein said current amplitude value determining means maintains said determined current amplitude value if said output power has varied by a predetermined amount.

A still yet further aspect of the present invention is the linear compressor driving device, wherein said linear compressor is used as part of a refrigerating cycle apparatus, and said current amplitude value determining means determines said current amplitude value based on an ambient temperature of said refrigerating cycle apparatus and a corresponding set temperature.

An additional aspect of the present invention is the linear compressor driving device, wherein said current amplitude value determining means determines said current amplitude value so as to reduce a difference between said ambient temperature and said set temperature.

A still additional aspect of the present invention is the linear compressor driving device, wherein said current amplitude value determining means determines said current amplitude value in a manner such that said calculated output power equals a set power to be input to said linear compressor, the power being set based on said ambient temperature and said set temperature.

A yet additional aspect of the present invention is the linear compressor driving device wherein said current amplitude value determining means gradually increases said current amplitude value when said linear compressor is actuated.

A still yet of the present invention is the linear compressor driving device, wherein said current amplitude value determining means gradually reduces said current amplitude value when said linear compressor is stopped.

A supplementary aspect of the present invention is a linear compressor driving device for linear compressor driving a piston in a cylinder by means of a linear motor to generate a compressed gas, comprising:

an inverter for outputting an alternating current to be supplied to said linear motor;

input current detecting means for detecting an input current to said inverter;

current amplitude value determining means for determining a current amplitude value of an output current of said inverter;

input power calculating means for calculating an input power to said inverter based on (1) said detected input current and (2) a predetermined or detected input voltage to said inverter;

frequency determining means for determining a frequency of the output current of said inverter such that said input power is maximum; and inverter controller for controlling said inverter based on said determined current amplitude value and said determined frequency.

A still supplementary aspect of the present invention is a medium which can be processed by a computer to carry programs and/or data for causing the computer to execute all or some of functions of all or some of the means of the present invention.

A yet supplementary aspect of the present invention is an information assembly comprising programs and/or data for causing a computer to execute all or some of functions of all or some of the means of the present invention.

[Description of Symbols]

1 . . . Linear compressor

Figure 1:
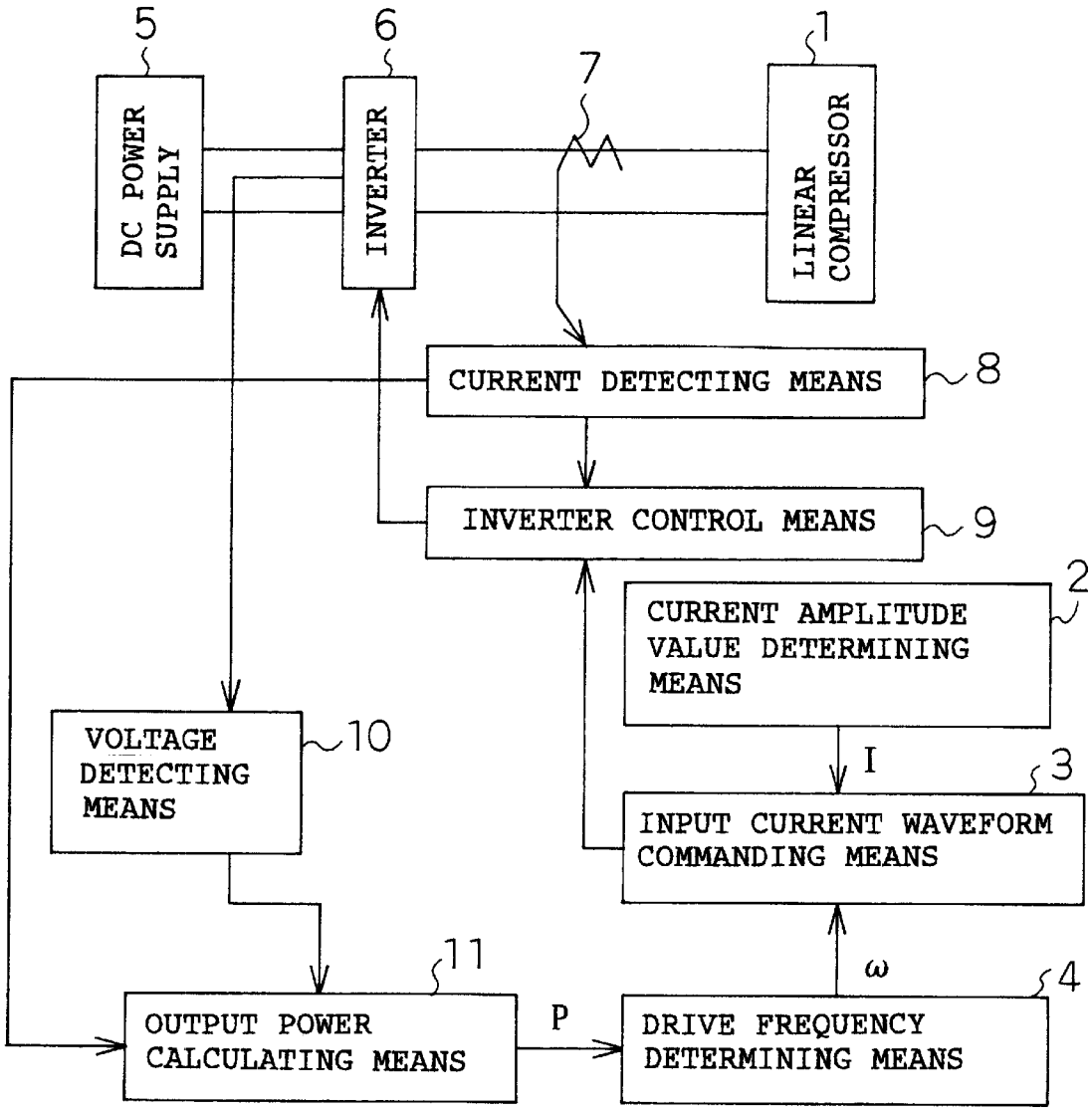
FIG. 1 is a block diagram of a linear compressor driving device according to Embodiment 1 of the present invention.

2 . . . Current amplitude value determining means

3 . . . Input current waveform commanding means
4 . . . Drive frequency determining means
5 . . . DC power supply
6 . . . Inverter
7 . . . Current sensor
8 . . . Current detecting means
7'. . . Current sensor
8'. . . Input Current detecting means
8". . . Output Current detecting means
10'. . . Voltage detecting means
11'. . . Input power calculating means
9 . . . Inverter controller
10 . . . Voltage detecting means
11 . . . Output power calculating means
12 . . . DC voltage detecting means
13 . . . Output voltage calculating means
60 . . . Cylinder
61 . . . Piston
62 . . . Magnet
63 . . . Outer yoke
64 . . . Stator
65 . . . Compression chamber
66 . . . Suction pipe
67 . . . Discharge pipe
68 . . . Suction valve
69 . . . Discharge valve
70 . . . Resonance spring
71 . . . Linear motor

DETAILED DESCRIPTION OF THE PREFERRED EMBODIMENTS

Embodiments of the present invention will be described with reference to the drawings. The present invention is characterized in that a linear compressor can be efficiently driven by inputting a constant current amplitude to the linear motor and adjusting the frequency of the input current so as to maximize the input to the linear motor. This will be logically explained in a latter half of Embodiment 1.

(Embodiment 1)

First, the configuration of a linear compressor driving device according to Embodiment 1 will be described with reference to FIG. 1, which is a block diagram of this device.

The linear compressor driving device comprises a DC power supply 5, current detecting means 8, voltage detecting means 10, output power calculating means 11, inverter controller 9, an inverter 6, current amplitude value determining means 2, and driving frequency determining means 4, and input current waveform commanding means 3. Means including the inverter controller 9 and the input current waveform commanding means 3 corresponds to inverter controller according to the present invention.

Next, the configuration of the linear compressor driving device according to the present invention will be explained in detail.

The DC power supply 5 supplies a DC voltage to the inverter 6 and generally comprises an AC power supply, a diode bridge for rectifying an alternating current from the AC power supply, and a smoothing capacitor.

The current detecting means 8 detects through a current sensor 7 a current supplied to a linear motor (not shown) that drives the linear compressor 1.

The voltage detecting means 10 detects through the inverter 6 a voltage supplied to the linear motor that drives the linear compressor 1. An output from the inverter 6, however, has a PWM (Pulse Width Modulation) waveform and cannot be directly measured easily. A lowpass filter comprising a transformer or capacitor and a resistor is thus used to shape and measure the PWM waveform.

The output power calculating means 11 calculates an inverter output power (hereafter simply referred to as an "output power") P using output current (detected by the current detecting means 8) and output voltage (detected by the voltage detecting means 10) from the inverter 6. Specifically, the inverter output power P is calculated by multiplying a measured instantaneous voltage by a measured instantaneous current to calculate an instantaneous power and accumulating the products for one period of a drive frequency or for a period corresponding to an integral multiple of this frequency. The output power P can be calculated by applying the instantaneous power to a lowpass filter. For example, the following calculation is possible:

The last calculated instantaneous power is multiplied by a predetermined weight (for example, 0.9999), the current calculated instantaneous power is multiplied by a weight (in the above mentioned example, 0.0001) that is 1 when added to the above mentioned weight, and the products are added together.

The inverter controller 9 controls the output PWM width of the inverter 6 in a fashion reducing the deviation between a command current waveform and the detected current. A specific control method comprises applying P (proportional) control or PI (proportional integration) control with an appropriate gain to the deviation between the command current waveform and the detected current so as to determine the output PWM width of the inverter 6.

The inverter 6 is driven with a PWM width determined by the inverter controller means 9. The inverter 6 may be a single-phase full bridge inverter or a single-phase half-bridge inverter.

The current amplitude value determining means 2 determines the amplitude value I of a current to be input to the linear motor to drive the linear compressor 1, from the state of the linear compressor 1 or the state of a system with the linear compressor 1 integrated thereinto.

When the amplitude of a current input to the linear motor is constant, the drive frequency determining means 4 adjusts and determines a frequency such that the input power to the linear motor measured by the output power calculating means 11 is maximized.

The input current waveform commanding means 3 produces a current waveform having the determined amplitude value I and frequency $\omega$ and commanding the inverter controller 9 to output a similar waveform.

Figure 2:
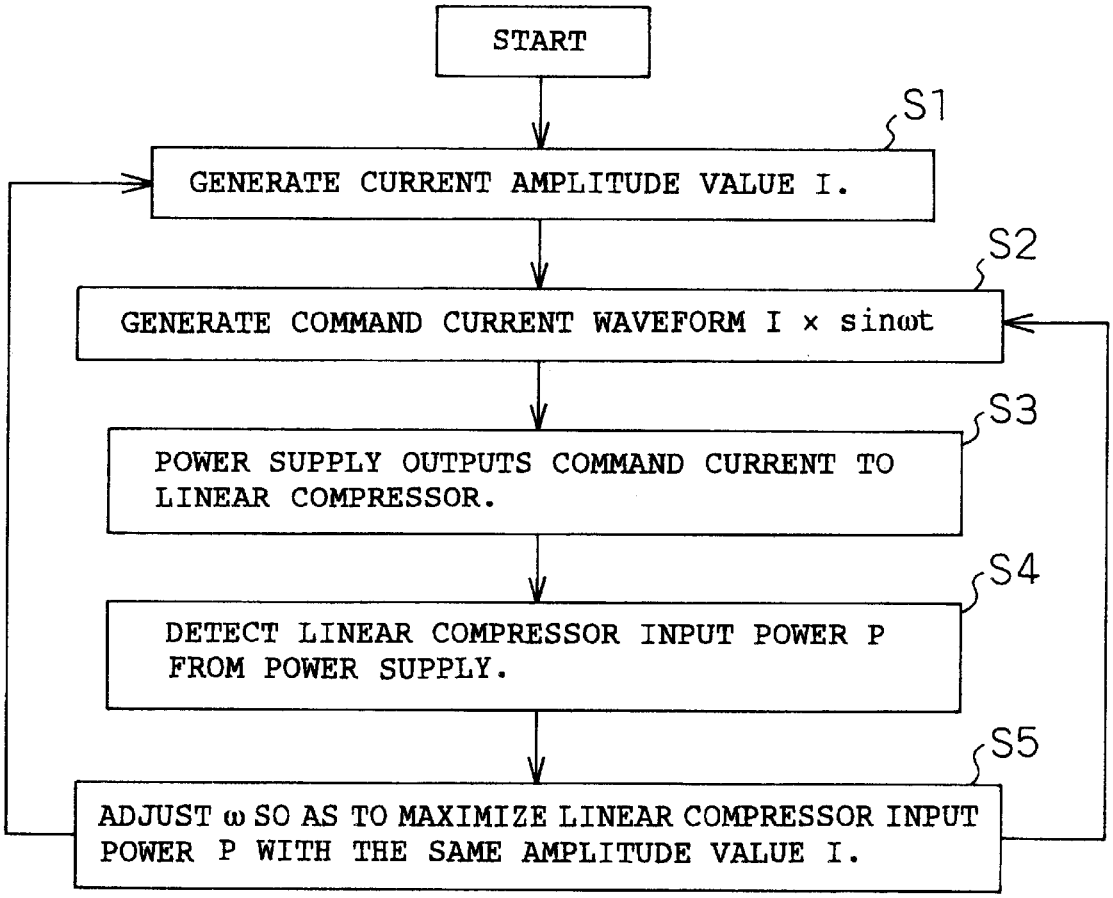
FIG. 2 is a flow chart showing a control operation performed by the linear compressor driving device according to Embodiment 1 of the present invention.

Next, the operation of the linear compressor driving device according to this embodiment will be described with reference to FIG. 2, which is a flow chart showing a control operation for this device.

When the linear compressor 1 is actuated and then becomes steady and activation of a control method according to the present invention is specified, the current amplitude value determining means 2 determines, in step S1, the amplitude value I of the current to the linear motor (not shown) that drives the linear compressor 1, from the state of the linear compressor 1 or the state of the system with the linear compressor 1 integrated thereinto.

In step S2, the input current waveform commanding means 3 generates a command current waveform $I \times \sin\omega t$ from the amplitude value I determined by the current amplitude value determining means 2 and from the frequency $\omega$ determined by the drive frequency determining means 4.

In step S3, the inverter controller 9 and the inverter 6 supply a current to the linear compressor 1 based on the command current waveform $I \times \sin\omega t$ and the current detected by the current detecting means 8.

In step S4, the output current calculating means 11 measures the power P to be supplied to the linear compressor 1.

In step S5, under the condition that the current amplitude I supplied to the linear compressor 1 is constant, the drive frequency determining means 4 adjusts the frequency ω of the input current so as to maximize the supplied power P.

Steps S2 to S5 are repeated until the supplied power P is maximized. Once the supplied power P has been maximized, the process returns to step S1.

Figure 3:
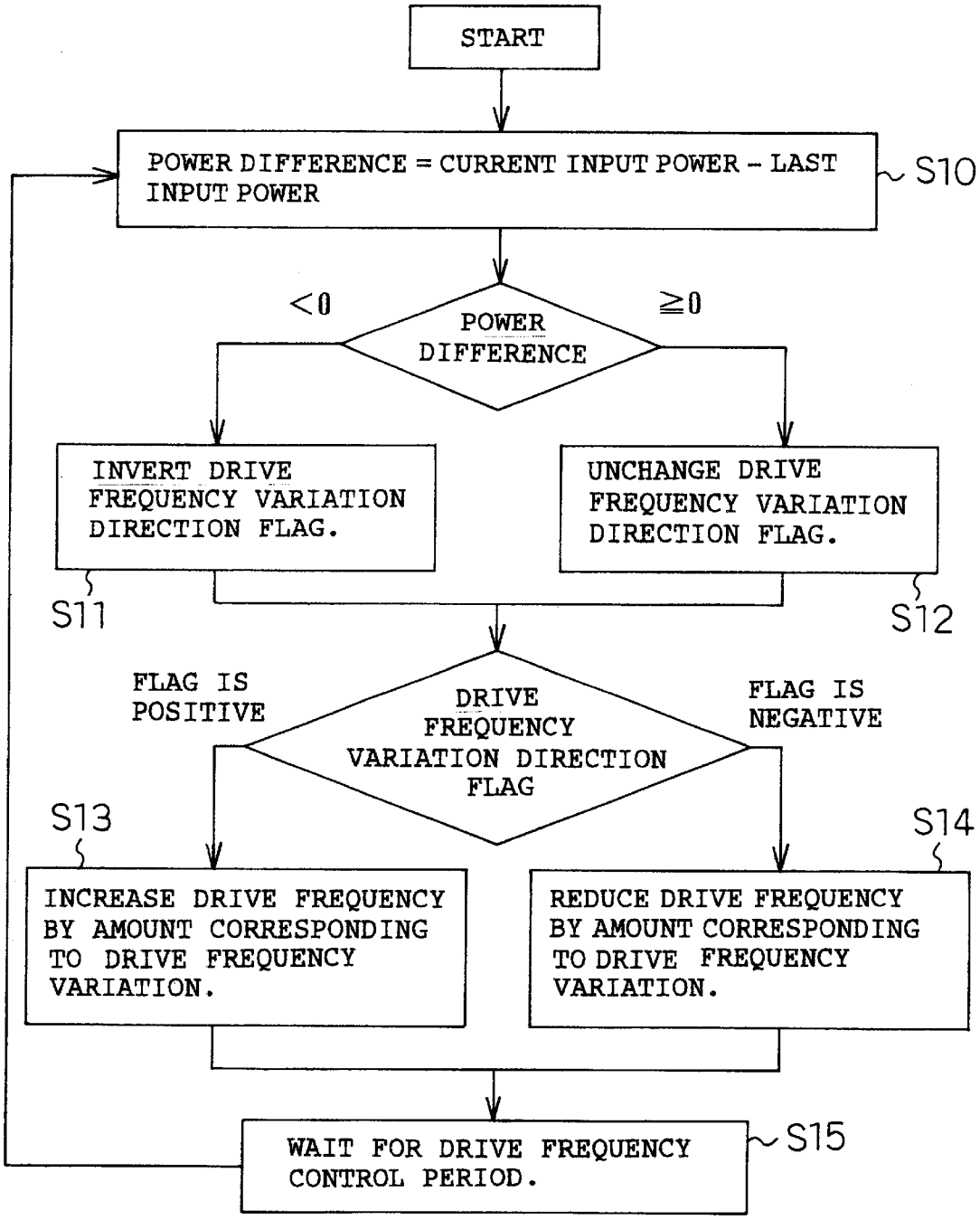
FIG. 3 is a flow chart showing a control operation performed by drive frequency determining means 4 according to Embodiment 1 of the present invention.

Next, the operation of the drive frequency determining means 4 will be described in detail with reference to FIG. 3, which is a flow chart showing control operation for the drive frequency determining means 4.

In the following, two variables (that is, a drive frequency variation period and a drive frequency variation) and one flag (that is, a drive frequency variation direction flag) are used. The drive frequency variation period is a control period during the time when the drive frequency determining means 4 is operating, and the drive frequency variation is an amount by which the drive frequency varies when the drive frequency determining means 4 performs one operation. Additionally, the drive frequency variation direction flag is based on a direction in which the drive frequency determined by the drive frequency determining means 4 varies. When this flag is 1, it indicates an increase in frequency, and when it is −1, it indicates a decrease in frequency.

When the drive frequency determining means 4 is invoked, the power input to the linear compressor 1 when the drive frequency determining means 4 was invoked last time is compared with the current power in step S10. Specifically, the current power is subtracted from the last power to calculate the difference therebetween.

If the difference in power is negative, this indicates that the last determined drive frequency has been changed in a direction in which it deviates from the maximum power drive frequency of the linear compressor 1. The drive frequency variation direction flag is inverted in step S11. On the other hand, if the difference in power is positive or zero, this indicates that the last determined drive frequency has been changed in a direction in which it follows the maximum power drive frequency of the linear compressor 1. The drive frequency variation direction flag is maintained as it is in step S12.

If the drive frequency variation direction flag is positive, the drive frequency is determined by increasing it by an amount corresponding to the drive frequency variation in step S13. On the contrary, if the drive frequency variation direction flag is negative, the drive frequency is determined by reducing it by the drive frequency variation in step S14.

The process waits during the drive frequency variation period in step S15 and then returns to step S10.

In this manner, the drive frequency determining means 4 varies the drive frequency in each drive frequency variation period by the amount corresponding to the drive frequency variation so as to maximize the power input to the linear compressor 1.

In this regard, when loads on the linear compressor are unstable, the input power varies even if the drive frequency is not varied, so that the drive frequency may be determined by the drive frequency determining means 4 in a direction in which it deviates from the maximum power drive frequency of the linear compressor 1. A setting is thus possible such that if the drive frequency determining means 4 varies the drive frequency at least twice in the same direction to thereby vary the power by a predetermined value or more, the last determined drive frequency is maintained, thereby preventing the drive frequency from varying until the loads are stabilized. This hinders the drive frequency determining means 4 from determining the drive frequency in a direction in which it deviates from the maximum power drive frequency even when the loads are unstable, thereby enabling a stable operation. Of course, the above described determined value may be a specific one or one based on power measured at a predetermined point of time (for example, a value corresponding to 10% of the power measured when the drive frequency is to be determined).

Additionally, when the variation of the power is large, the drive frequency is assumed to deviate significantly from the maximum power drive frequency and the drive frequency variation period may thus be reduced. When the variation of the power is small, the drive frequency is assumed to be close to the maximum power drive frequency and the drive frequency variation period may thus be increased. This enables the maximum power drive frequency to be stably followed at a high speed.

Further, with the above described method, the drive frequency determining means 4 constantly varies the drive frequency so as to maximize the power, so that in each drive frequency variation period, the drive frequency varies around the drive frequency corresponding to the maximum power by the amount corresponding to the drive frequency variation. Thus, driving with a drive frequency deviating from the one corresponding to the maximum power may not be negligible. Then, when the variation of the power is large, since the drive frequency is assumed to deviate significantly from the maximum power drive frequency, the drive frequency variation may be increased. When the variation of the power is small, since the drive frequency is assumed to be close to the maximum power drive frequency, the drive frequency variation may be reduced. This enables the maximum power drive frequency to be stably followed at a high speed.

Additionally, the current amplitude value must be varied in order to efficiently control the linear compressor 1. Since, however, the operation of the driving frequency determining means 4 is not ensured under conditions other than the one that the current amplitude value is constant, the driving frequency determining means 4 may determine a drive frequency that deviates significantly from the maximum power drive frequency of the linear compressor 1 when the current amplitude value changes. Thus, while the current amplitude value is varying, the operation of the drive frequency determining means 4 is stopped to enable a stable operation to be performed while varying the current amplitude value.

Additionally, the current amplitude value may be changed by a larger amount than is required because the drive frequency determined by the drive frequency determining means 4 deviates from the maximum power drive frequency of the linear compressor 1. Thus, if the variation of the power is equal to or larger than a fixed value, since the drive frequency is assumed to deviate from the maximum power drive frequency of the linear compressor 1, the drive frequency determining means 4 may prevent the current amplitude value from varying. This enables a stable operation without unnecessarily increasing the current.

Figure 4:
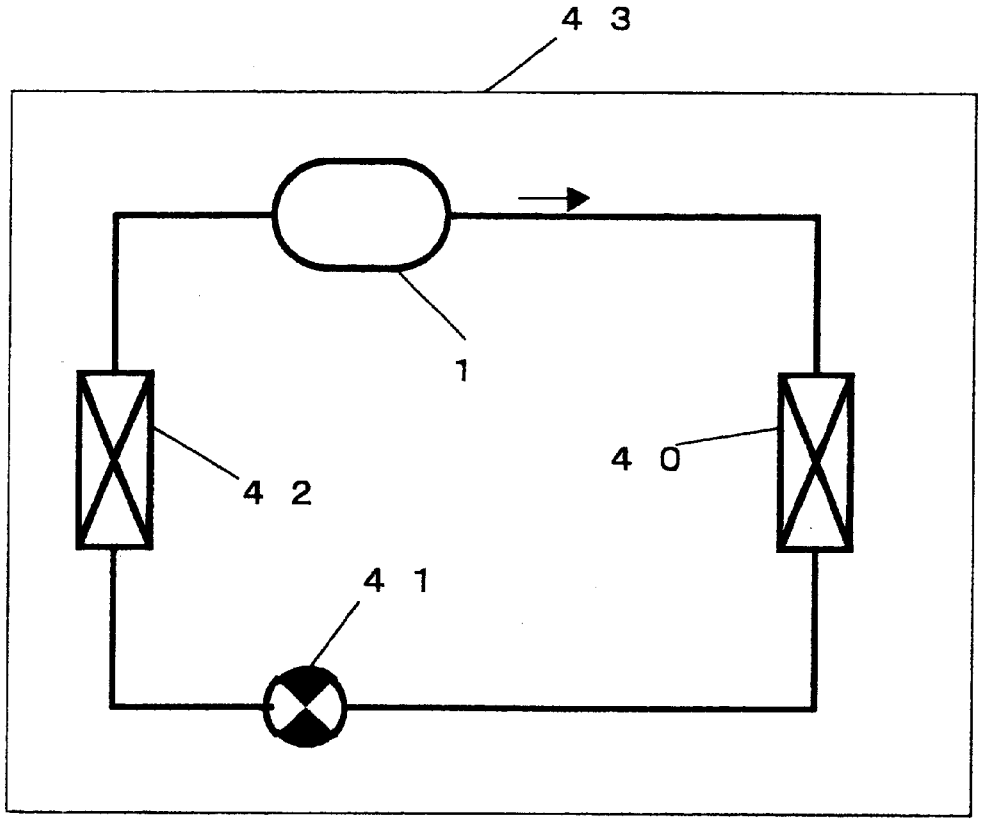
FIG. 4 is a block diagram of a refrigerating cycle apparatus using the linear compressor driving device according to Embodiment 1 of the present invention.

Further, as shown in FIG. 4, which is a block diagram of a refrigerating cycle apparatus using the linear compressor driving device according to this embodiment, if the linear compressor driving device is used as part of a refrigerating cycle apparatus 43 comprising a condenser 40, an expansion device 41, and an evaporator 42, the current amplitude value determining means 2 determines the current amplitude value to be input to the linear compressor 1 based on an ambient temperature of at least one section of the refrigerating cycle apparatus 43 and a set temperature corresponding to the ambient temperature. Specifically, it determines the current amplitude value (1) by using proportional integration control so as to reduce the difference between the ambient temperature and the set temperature or (2) by referencing previously prepared table values relating to such temperature differences. In this case, the linear compressor driving device can also control the linear compressor 1 so as to achieve a temperature desired by the user. Alternatively, the current amplitude value can be determined so as to obtain power to be input to the linear compressor 1, the value of which is calculated based on the difference between the ambient temperature and the set temperature.

Additionally, when the linear compressor 1 is activated, a gas contained therein has not been stabilized, so that a rapid increase in current amplitude value may cause a tip portion of the piston and a head of the cylinder to collide against each other. The current amplitude value determining means 2 thus gradually increases the current amplitude value on activation. On the contrary, when the linear compressor 1 is stopped, since there is a difference between a suction pressure and an discharge pressure, a rapid decrease in the current amplitude value may cause the tip portion of the piston and the head of the cylinder to collide against each other or a spring used for resonance may be plastically deformed. The current amplitude value determining means 2 thus gradually reduces the current amplitude value on stopping.

Additionally, the control of the inverter need not be carried out based on the calculation of the output power of the inverter as in the above described embodiment, but may instead be carried out based on the calculation of the input power of the inverter, because the input power of the inverter is assumed to be equal to the output power of the inverter.

Figure 9:
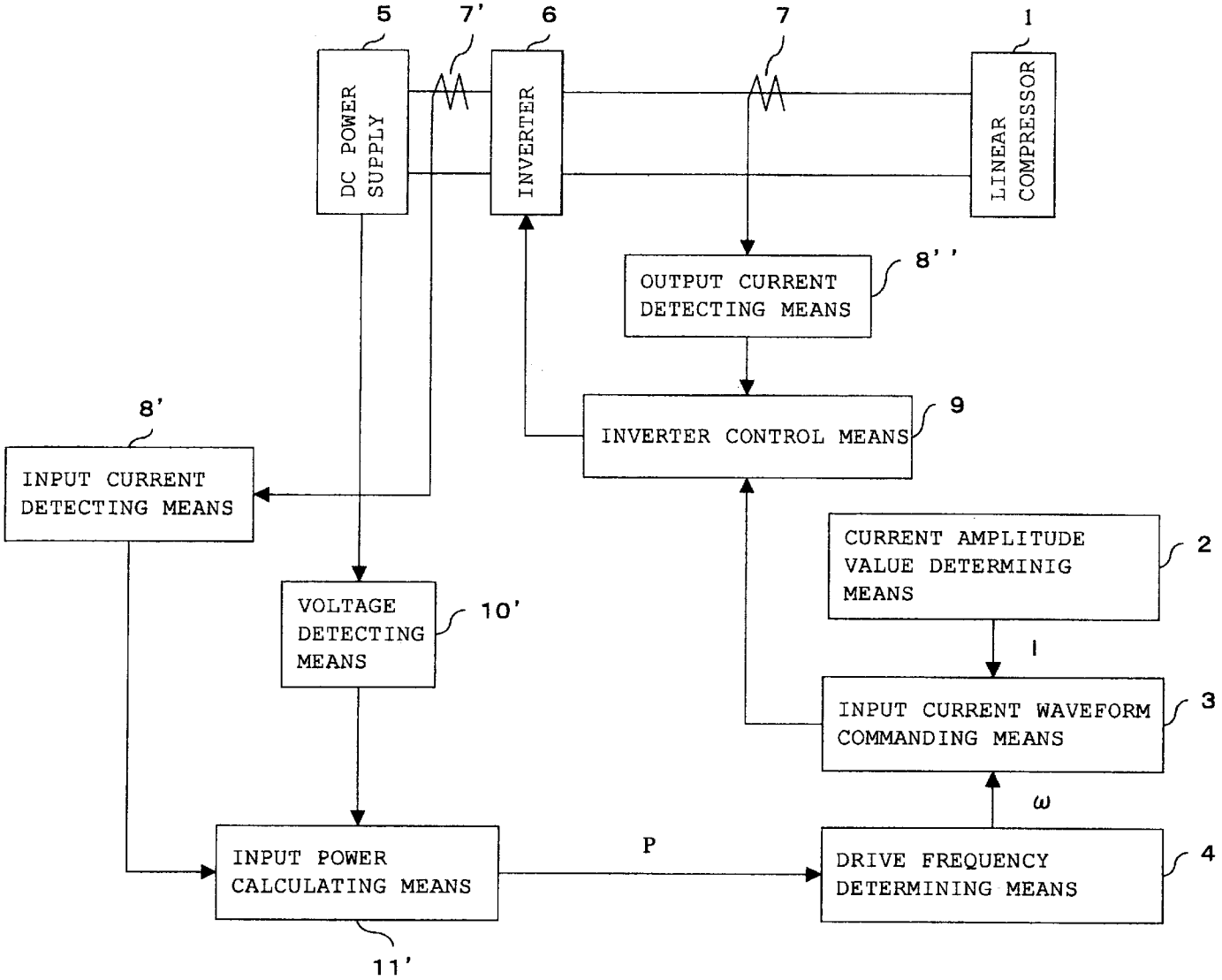
FIG. 9 is a block diagram of a linear compressor driving device according to the present invention.

In such a case, a linear compressor driving device of the present invention is, for example, as shown in FIG. 9, a linear compressor driving device for linear compressor 1 driving a piston in a cylinder by means of a linear motor to generate a compressed gas, comprising:

an inverter 6 for outputting an alternating current to be supplied to the linear motor;

input current detecting means 8' for detecting an input current to the inverter 6;

output current detecting means 8" for detecting an output current from the inverter 6;

current amplitude value determining means 2 for determining a current amplitude value of the output current of the inverter 6;

input power calculating means 11' for calculating an input power to the inverter 6 based on (1) the detected input current and (2) an input voltage to the inverter 6 detected by the voltage detecting means 10';

drive frequency determining means 4 for determining a frequency of the output current of the inverter 6 such that the input power is maximum; and inverter controller 9 for controlling the inverter 6, by using the result of detection by the output current detecting means 8", based on the determined current amplitude value and the determined frequency.

Here, the input voltage to the inverter in the present invention is detected by the voltage detecting means in the above example, but this is not a limitation, and instead, for example, a predetermined value may be used as the input voltage.

Specifically, when a power factor correction converter (hereafter referred to as the "PFC converter") is used as a DC power supply, the input current of the inverter may be calculated, as the iuput power to the PFC converter, based on (1) an amplitude value of an input current to the PFC converter which has been detected, and (2) a predetermined amplitude value of an input voltage to the PFC converter.

Additionally, the output current from the inverter need not be detected by the output current detecting means as described above. For example, when the control of the inverter in the present invention is carried out by the open-loop control (not by the feedback control), an output current detecting means is unnecessary.

Next, as described above, features of the linear compressor driving device according to the present invention will be explained referring to Equations (1) to (3) as theoretical evidence.

The relationship between input and output energy in the linear motor for driving the linear compressor can be expressed as follows:

[Equation 1]

$$P_i = P_o + \tfrac{1}{2} \times R \times I^2$$

where $P_o$ denotes an average output energy of the linear motor, $P_i$ denotes an average input energy thereof, R denotes an equivalent resistance present therein, and I denotes an amplitude of a sinusoidal current input thereto. The average input energy $P_i$ of the linear motor corresponds to the output power of the above described inverter 6.

As is apparent from Equation (1), a loss to the linear motor is Joule heat originating from the equivalent resistance present in the linear motor. If the equivalent resistance is invariable, the loss is determined only by the amplitude of the current and independently of the frequency thereof.

Further, the ratio between a linear compressor output $P_c$ (hereafter referred to as the "linear motor output") and the average output energy $P_o$ of the linear motor (this ratio is hereafter referred to as the "compressor mechanical efficiency") meets the following equation:

[Equation 2]

$$P_c = \eta_m \times P_o$$

where $P_c$ denotes the linear compressor output and $\eta_m$ denotes the compressor mechanical efficiency.

The ratio between the linear compressor output $P_c$ and the average input energy $P_i$ of the linear motor (this ratio is hereafter also referred to as the "general efficiency") is expressed by:

[Equation 3]

$$\begin{aligned} \eta &= P_c / P_i \\ &= (\eta_m \times p_o)/(p_o + 1/2 \times R \times I^2) \\ &= \eta_m / (1 + (1/2 \times R \times I^2)/P_o) \end{aligned}$$

where η denotes the general efficiency.

The compressor mechanical efficiency $\eta_m$ may be assumed to be constant near a certain operational state of the linear compressor. Accordingly, Equation (3) indicates that when the linear compressor is driven while maintaining a constant amplitude I of the sinusoidal current input to the linear motor, the average output energy $P_o$ of the linear motor may be controlled to be maximized in order to maximize the general efficiency η. Additionally, since the linear compressor is driven while maintaining the constant amplitude I of the sinusoidal current input to the linear motor, Equation (1) indicates that maximizing the average output energy $P_o$ of the linear motor means maximizing the average input energy $P_i$ of the linear motor.

The above description theoretically proves that the linear compressor can be efficiently driven by maintaining the constant amplitude I of the sinusoidal current to be input to the linear motor while adjusting the frequency of the input current so as to maximize the average input energy (that is the power output) of the linear motor.

Figure 5:
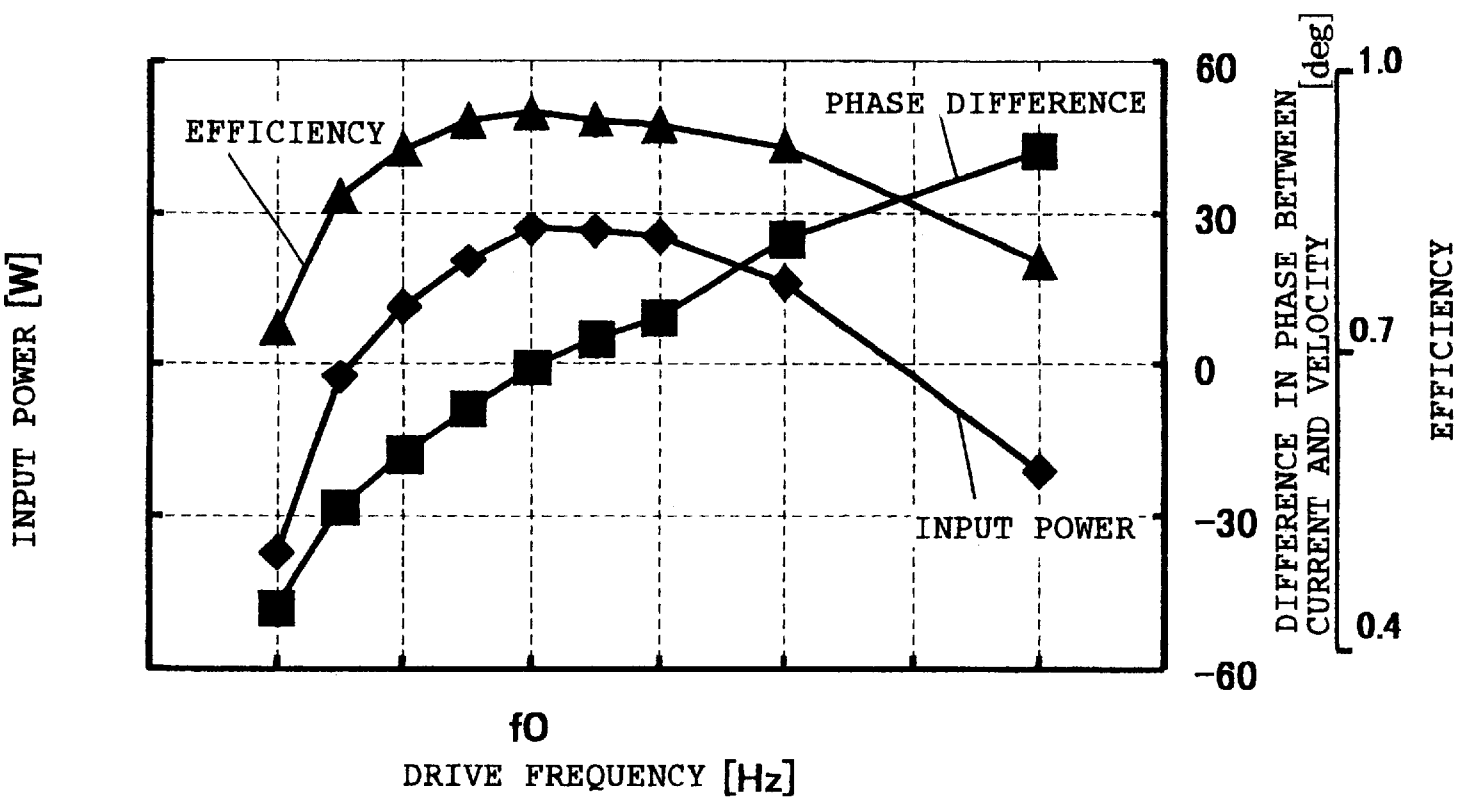
FIG. 5 is a graph showing results of measurements of three physical quantities including input power, a difference of the phases between piston velocity and a current, and efficiency which were obtained when a drive frequency is varied while maintaining a current amplitude value.

Next, a graph showing experimental results according to this embodiment is shown in FIG. 5 to further describe the validity of the configuration of the present invention using these results. FIG. 5 shows results of measurements of three physical quantities including input power, a difference in phase between piston velocity and current, and efficiency, which were obtained when the drive frequency was varied while maintaining a constant amplitude value for the current input to the linear compressor according to this embodiment. Here, the efficiency is a value relative to a certain reference value.

The experimental results in FIG. 5 indicate that the linear compressor can be driven with a maximum efficiency by determining the drive frequency (in the drawing, it is denoted by f0) so as to maximize the input power to the linear compressor according to this embodiment while maintaining the constant amplitude value for the current input to the linear compressor. The figure also shows that while the linear compressor is being driven with the maximum efficiency, the piston velocity and the current are in phase, indicating that the linear compressor is resonant.

(Embodiment 2)

Figure 6:
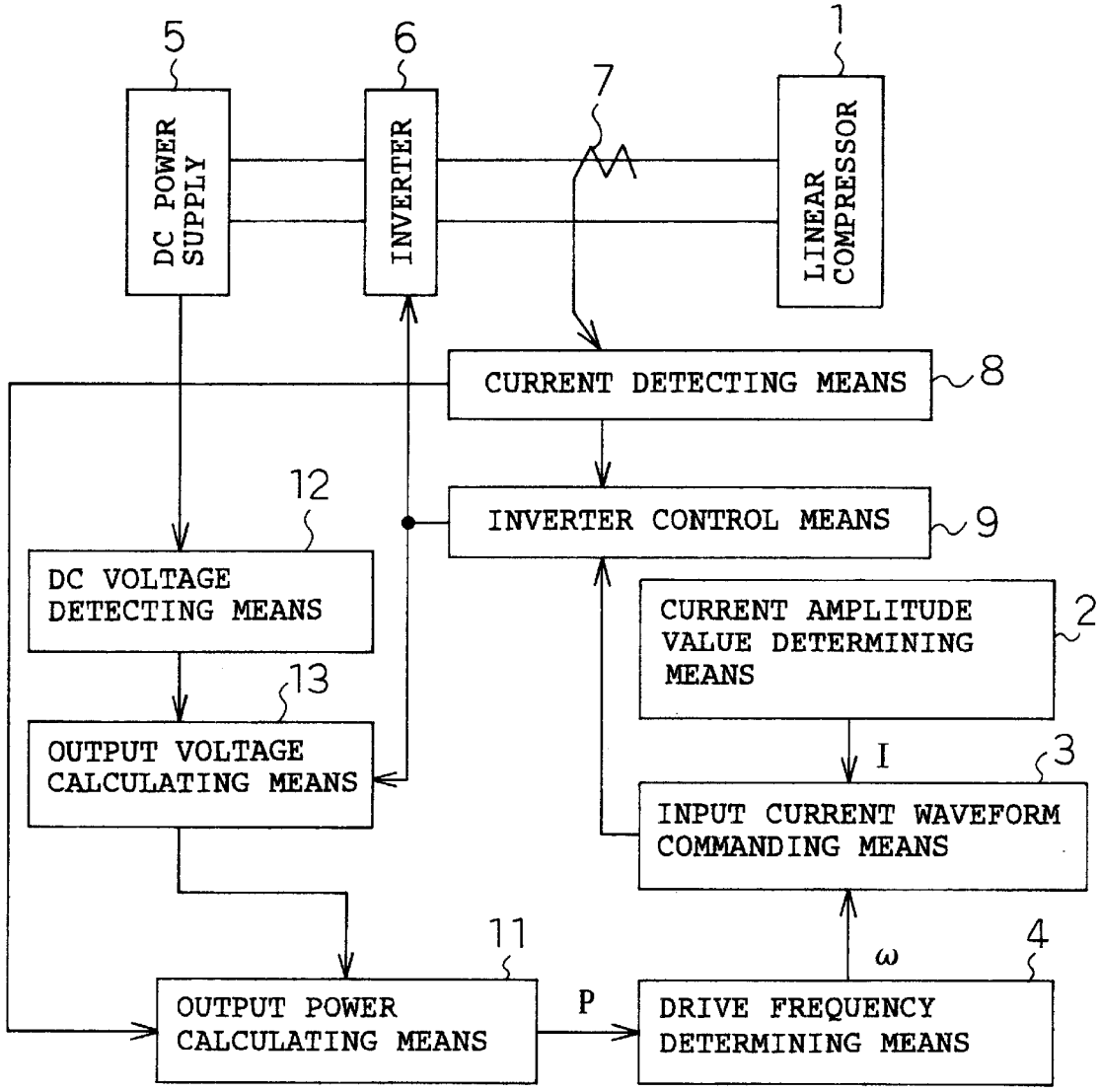
FIG. 6 is a block diagram of a linear compressor driving device according to Embodiment 2 of the present invention.
Figure 7:
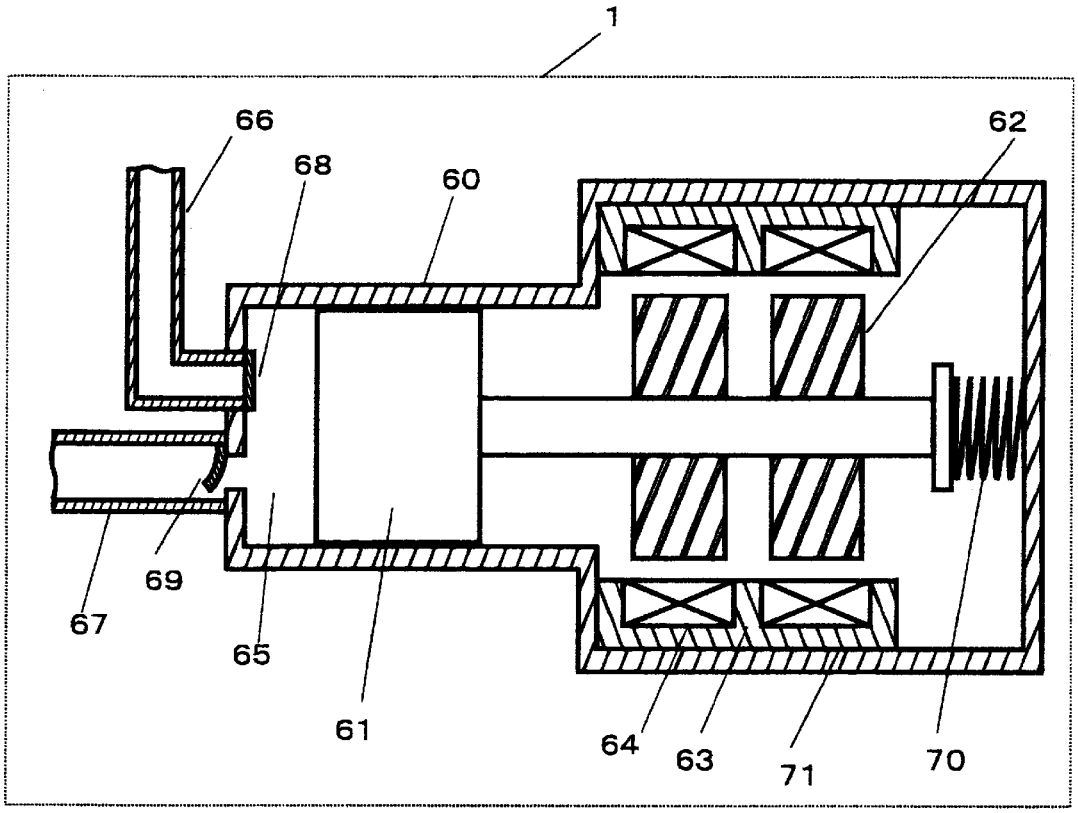
Fig. 7 PRIOR ART
FIG. 7 is a view showing the configuration of a conventional linear compressor.
Figure 8:
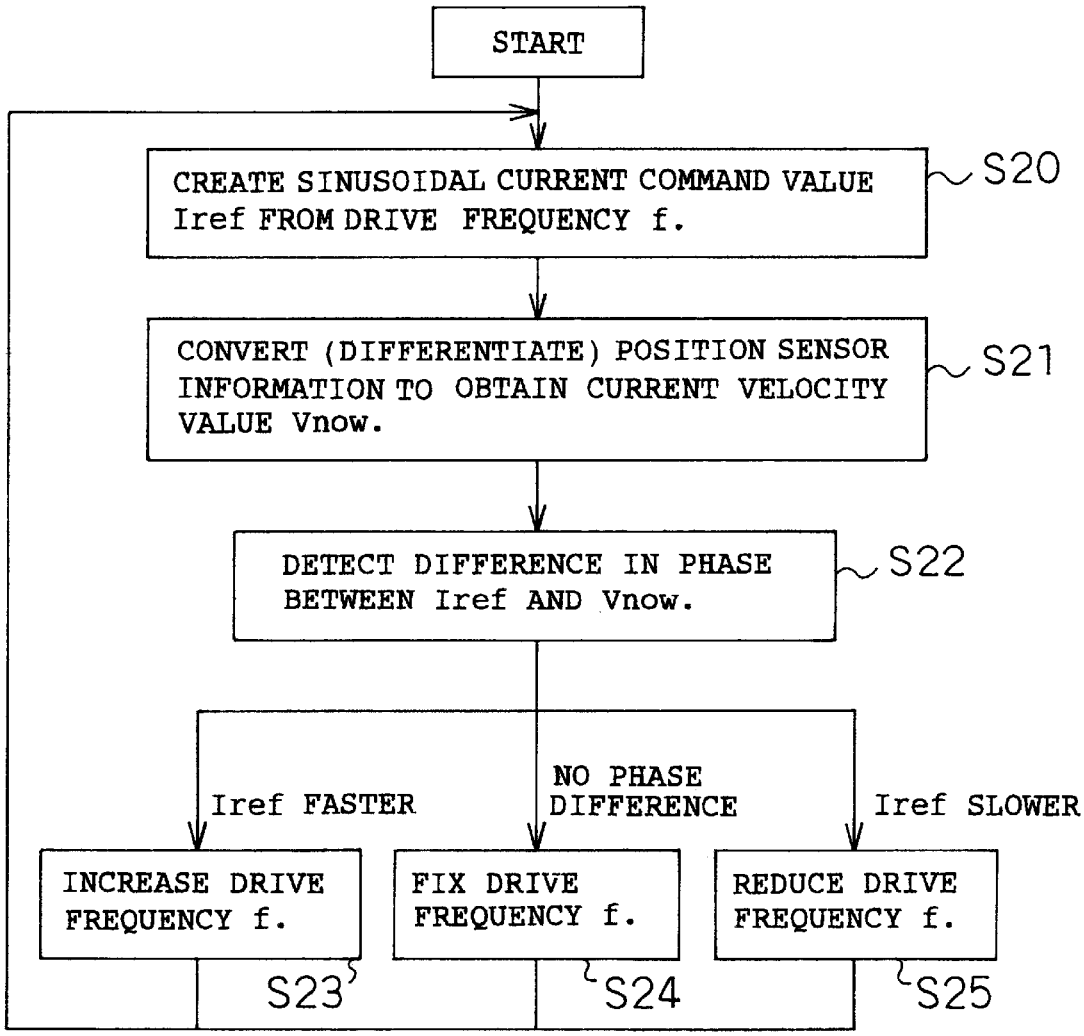
Fig. 8 PRIOR ART
FIG. 8 is a flow chart useful in explaining a resonance following operation performed by a conventional linear compressor with a position sensor.

Next, the configuration and operation of a linear compressor driving device according to Embodiment 2 will be described with reference to FIG. 6, which is a block diagram of this device.

The linear compressor driving device according to this embodiment has substantially the same configuration as that according to the previously described Embodiment 1, but the means for detecting a voltage comprises DC voltage detecting means 12 and output voltage calculating means 13.

The above described Embodiment 1 directly detects the output voltage from the inverter. A ground for a controller for the inverter, however, has the same potential as a ground for an input DC voltage. Accordingly, detecting the output voltage from the inverter requires a circuit part such as a transformer or a photocoupler for insulation. According to Embodiment 2, the output voltage from the inverter is indirectly calculated to eliminate the necessity of such a circuit part in order to reduce the number of parts required for a control circuit as well as the size thereof.

The DC voltage detecting means 12 detects a DC voltage supplied from the DC power supply 5 to the inverter 6. Specifically, it detects the DC voltage by means of resistive potential division.

The output voltage calculating means 13 calculates the output voltage from the inverter 6, from the DC voltage input to the inverter 6 and from PWM width transmitted to the inverter 6 from the inverter controller 9. The output voltage from the inverter 6 is calculated without using any transformer or any lowpass filter as described above for Embodiment 1.

Here, the output voltage from the inverter 6 has two values including zero and the value of an input voltage Vdc, where a period when the voltage Vdc is output corresponds to the PWM width determined by the inverter controller 9. This enables a voltage value between 0 and the Vdc to be expressed to calculate a voltage to be output, from the ratio between the input voltage Vdc and the PWM width.

However, a difference between a PWM width actually communicated to the inverter 6 by the inverter controller 9 and that actually output from the inverter 6 must be taken into consideration. Such a phenomenon may be caused by a delay in a drive circuit for driving the inverter 6, a dead time provided to avoid short-circuit protection for the inverter 6, or a delay in a power semiconductor device configuring the inverter 6.

Except for the above operations, the linear compressor driving device according to this embodiment operates in substantially the same manner as that according to Embodiment 1.

As apparent from the above description, the present invention comprises the linear compressor driving device that calculates the resonance frequency from the input voltage to the linear motor for driving the linear compressor instead of, for example, displacement of the cylinder in the linear compressor, thereby efficiently driving the linear compressor.

Alternatively, the present invention provides a driving device for a linear compressor comprising, for example, a piston and a cylinder surrounding the piston, the piston being driven by a linear motor and using a mechanically elastic member or elasticity of a compressed gas that is generated in a compression chamber formed of the cylinder and the piston, in which the driving device comprises a DC power supply, an inverter, current amplitude value determining means, input current waveform commanding means, current detecting means, voltage detecting means, output voltage calculating means, inverter controller, and drive frequency determining means. The DC power supply supplies a DC voltage to the inverter. The inverter is driven with a PWM width determined by the inverter controller. The current amplitude value determining means determines an amplitude value for a sinusoidal current output from the inverter driving the linear compressor, based on a compelling force required by the linear compressor. The input current waveform commanding means informs the inverter controller of a current input to the linear motor, based on a amplitude value determined by the current amplitude value determining means and on a frequency determined by the drive frequency determining means. The current detecting means detects a current to be supplied from the inverter to the linear motor driving the linear compressor. The voltage detecting means detects a voltage to be supplied from the inverter to the linear motor driving the linear compressor. The output power calculating means calculates an output power from the inverter, from the output current and voltage from the inverter. The inverter controller controls the output PWM width from the inverter so as to reduce the deviation between a commanded current waveform and a detected current. The drive frequency determining means adjusts and determines a drive frequency so as to maximize the power detected by the output power calculating means while maintaining an amplitude value for the current output from the inverter. These points are characteristic of the present linear compressor driving device.

According to the present invention, for example, the voltage detecting means comprises DC voltage detecting means and output voltage calculating means, the DC voltage detecting means detecting a DC voltage supplied from the DC power supply to the inverter. The output voltage calculating means calculates the output voltage from the inverter, from the DC voltage input to the inverter and the PWM width transmitted to the inverter from the inverter controller. These points are characteristic of the present invention.

The present invention is also characterized in that, for example, the drive frequency determining means has variables including a drive frequency control period and a drive frequency variation and compares a power obtained through an operation with a drive frequency determined during a drive frequency control period before last with a power obtained through an operation with a drive frequency determined during the last drive frequency control period, in order to determine the present frequency by varying the drive frequency in the same direction as that during the last drive frequency control period, by an amount corresponding to the drive frequency variation if the power has increased, or varying the drive frequency in a direction opposite to that during the last drive frequency control period, by the amount corresponding to the drive frequency variation if the power has decreased.

The present invention is also characterized in that, for example, the drive frequency determining means determines the same drive frequency at least twice or more and maintains the drive frequency determined during the last drive frequency control period if the power has varied by a predetermined amount or more.

The present invention is also characterized in that, for example, the frequency determining means changes the drive frequency control period based on a variation in the power.

The present invention is also characterized in that, for example, the frequency determining means changes the drive frequency variation based on a variation in the power.

The present invention is also characterized in that, for example, when the current amplitude value determining means changes the current amplitude value, the drive frequency determining means stops an operation of the current amplitude value determining means and maintains the drive frequency.

The present invention is also characterized in that, for example, if the variation in the power obtained by the drive frequency determining means is a fixed amount or more, the current amplitude determining means stops the operation and maintains the current amplitude value.

The present invention is also characterized in that, for example, if the linear compressor is used as part of a refrigerating cycle apparatus comprising at least a condenser, an expansion device, and an evaporator, the current amplitude value determining means determines the current amplitude value for the current input to the linear compressor based on an ambient temperature of the refrigerating cycle apparatus in at least one location thereof and on a corresponding set temperature.

The present invention is also characterized in that, for example, the current amplitude value determining means determines the amplitude value for the current input to the linear compressor so as to reduce the difference between the ambient temperature and the set temperature.

The present invention is also characterized in that, for example, the current amplitude value determining means determines a set power input to the linear compressor, from the ambient and set temperatures, and determines the amplitude value for the current input to the linear compressor in such a manner that the output power obtained from the output power calculating means equals the set power.

The present invention is also characterized in that, for example, the current amplitude value determining means gradually increases the amplitude value for the current input to the linear compressor when the linear compressor is actuated.

The present invention is also characterized in that, for example, the current amplitude value determining means gradually reduces the amplitude value for the current input to the linear compressor when the linear compressor is stopped.

Moreover, the present invention provides a medium carrying programs and/or data for causing a computer to execute all or some of functions of all or some of the above described means of the present invention, wherein the programs and/or data can be read by the computer and when read, cooperate with the computer in executing the above described functions.

Additionally, the present invention provides a medium carrying programs and/or data for causing a computer to execute all or some of operations in all or some of the above described steps of the present invention, in which the programs and/or data can be read by the computer and when read, cooperate with the computer in executing the above described functions.

Further, the present invention provides an information assembly carrying programs and/or data for causing a computer to execute all or some of the functions of all or some of the above described means of the present invention, in which the programs and/or data can be read by the computer and when read, cooperate with the computer in executing the above described functions.

Furthermore, the present invention provides an information assembly carrying programs and/or data for causing a computer to execute all or some of the operations in all or some of the above described steps of the present invention, in which the programs and/or data can be read by the computer and when read, cooperate with the computer in executing the above described functions.

The data include a data structure, a data format, and a data type. The medium includes a recording medium such as a ROM, a transmission medium such as the Internet, and a transmission medium such as light or an electric or a sound wave. The carrying medium includes, for example, a recording medium having the programs and/or data recorded thereon, a transmission medium transmitting the programs and/or data, or the like. The expression "can be processed by the computer" means that for the recording medium such as a ROM, the programs and/or data can be read by the computer, while for the transmission medium, the transmitted programs and/or data can be handled by the computer as a result of the transmission. The information assembly includes, for example, software such as the programs and/or data.

As described above, the configuration of the present invention may be implemented either with software or with hardware.

In this manner, the present invention maintains the constant amplitude of the current supplied to the linear compressor while adjusting the frequency of the input current so as to maximize the power supplied to the compressor. Consequently, a variation in the resonance frequency arising from a variation in the load can be followed to increase the efficiency of the linear compressor. In addition, since this control method requires no position sensor for detecting the position of the piston, the size of the driving device for the linear compressor can be reduced, thereby reducing costs. Further, the controller according to the present invention enables the resonance frequency to be stably and promptly followed while maintaining the required capabilities.

As apparent from the above description, the present invention has an advantage of providing a linear compressor driving device that efficiently drives the linear compressor without using any displacement of the piston.

What is claimed is:

1. A linear compressor driving device for linear compressor driving a piston in a cylinder by means of a linear motor to generate a compressed gas, comprising:

an inverter for outputting an alternating current to be supplied to said linear motor;

current detecting means of detecting an output current from said inverter;

voltage detecting means of detecting an output voltage from said inverter;

current amplitude value determining means of determining a current amplitude value of said output current;

output power calculating means of calculating an output power from said inverter based on said detected output current and said detected output voltage;

frequency determining means of determining a frequency of said output current such that said output power is maximum; and inverter controller for controlling said inverter based on said determined current amplitude value and said determined frequency.

2. The linear compressor driving device according to claim 1, wherein said voltage detecting means has:

DC voltage detecting means of detecting a DC voltage input to said inverter; and output voltage calculating means of calculating the output voltage from said inverter based on a control signal transmitted from said inverter controller to said inverter and on said detected DC voltage.

3. The linear compressor driving device according to claim 1 or 2, wherein said frequency determining means has two variables including a frequency control period and a frequency variation to compare said output power obtained through an operation with a frequency determined during said frequency control period before last with said output power obtained through an operation with a frequency determined during the last frequency control period, in order to determine a present frequency (1) by varying said frequency in the same direction as that during said last frequency control period, by an amount corresponding to said frequency variation if said output power has increased, and (2) by varying said frequency in a direction opposite to that during said last frequency control period, by said amount corresponding to said frequency variation if said output power has decreased.

4. The linear compressor driving device according to claim 3, wherein said frequency determining means varies said frequency in said same direction a predetermined number of times or more, and maintains the frequency determined during said last frequency control period if said output power has varied by a predetermined amount or more.

5. The linear compressor driving device according to claim 3, wherein said frequency determining means changes said frequency control period based on a variation in said output power.

6. The linear compressor driving device according to claim 3, wherein said frequency determining means changes said frequency variation based on a variation in said output power.

7. The linear compressor driving device according to claim 1, wherein said frequency determining means maintains said determined frequency if said determined current amplitude value has varied.

8. The linear compressor driving device according to claim 1, wherein said current amplitude value determining means maintains said determined current amplitude value if said output power has varied by a predetermined amount.

9. The linear compressor driving device according to claim 1, wherein said linear compressor is used as part of a refrigerating cycle apparatus, and said current amplitude value determining means determines said current amplitude value based on an ambient temperature of said refrigerating cycle apparatus and a corresponding set temperature.

10. The linear compressor driving device according to claim 9, wherein said current amplitude value determining means determines said current amplitude value so as to reduce a difference between said ambient temperature and said set temperature.

11. The linear compressor driving device according to claim 9, wherein said current amplitude value determining means determines said current amplitude value in a manner such that said calculated output power equals a set power to be input to said linear compressor, the power being set based on said ambient temperature and said set temperature.

12. The linear compressor driving device according to claim 1, wherein said current amplitude value determining means gradually increases said current amplitude value when said linear compressor is actuated.

13. The linear compressor driving device according to claim 1, wherein said current amplitude value determining means gradually reduces said current amplitude value when said linear compressor is stopped.

14. A linear compressor driving device for linear compressor driving a piston in a cylinder by means of a linear motor to generate a compressed gas, comprising:

an inverter for outputting an alternating current to be supplied to said linear motor;

input current detecting means of detecting an input current to said inverter;

current amplitude value determining means of determining a current amplitude value of an output current of said inverter;

input power calculating means of calculating an input power to said inverter based on (1) said detected input current an (2) a predetermined or detected input voltage to said inverter;

frequency determining means of determining a frequency of the output current of said inverter such that said input power is maximum; and inverter controller for controlling said inverter based on said determined current amplitude value and said determined frequency.

15. A medium which can be processed by a computer to carry programs and/or data for causing the computer to execute all or some of functions of all or some of the means of the present invention according to any one of claims 1, 2, 7, 8, 9, 12, 13 and 14.

16. An information assembly comprising programs and/or data for causing a computer to execute all or some of functions of all or some of the means of the present invention according to any one of claims 1, 2, 7, 8, 9, 12, 13 and 14.

17. A method for controlling linear compressor driving device powered by an alternating current supply, comprising the steps of:

(a) measuring the power provided by the alternating current supply to the linear compressor driving device;

(b) adjusting the current to the linear compressor driving device to a predetermined amplitude level;

(c) adjustably controlling variation in frequency of the current to the linear compressor driving device, while maintaining the predetermined amplitude level constant; and (d) adjusting the frequency of step (c) so that the power measured in step (a) is a maximum.

18. The method of claim 17 in which step (b) includes determining the predetermined amplitude level based on a temperature setting of an apparatus being driven by the linear compressor driving device.

* * * * *